United States Patent [19]

Bertrand

[11] Patent Number: 4,826,464

[45] Date of Patent: May 2, 1989

[54] PIVOT STRUCTURE AND PIVOT JOINT FOR CONSTRUCTION TOY ASSEMBLIES

[75] Inventor: Vic Bertrand, Dollard des Ormeaux, Canada

[73] Assignee: The Ritvik Group Inc., Dorval, Canada

[21] Appl. No.: 100,211

[22] Filed: Sep. 23, 1987

[51] Int. Cl.[4] ..... A63H 33/04

[52] U.S. Cl. ..... 446/120; 446/122; 446/124

[58] Field of Search ..... 446/102, 104, 120, 122, 446/124, 126, 128, 487

[56] References Cited

U.S. PATENT DOCUMENTS

| | | | |
|---|---|---|---|
| 3,034,254 | 5/1962 | Christiansen | 446/128 |
| 3,640,017 | 2/1972 | Christiansen | 446/128 X |
| 4,185,410 | 1/1980 | Kristiansen | 446/104 |
| 4,606,732 | 8/1986 | Lyman | 446/104 X |

FOREIGN PATENT DOCUMENTS

| | | | |
|---|---|---|---|
| 702336 | 1/1965 | Canada | 446/120 |
| 2118447 A | 11/1983 | United Kingdom | 446/128 U X |

*Primary Examiner*—Robert A. Hafer
*Assistant Examiner*—Sam Rimell
*Attorney, Agent, or Firm*—Robic, Robic Associates

[57] ABSTRACT

A pivot structure comprises a one-piece plastic support including a parallelepiped rectangular body having a sidewall and a pivot bracket projecting from this sidewall. It comprises also a one-piece plastic bar section which includes a base plate, a columnar connector having an essentially constant cross-section and projecting from one face of the base plate; an L-shaped connector with a first leg upstanding at one end from one edge of the base plate, spacedly of the columnar connector, and a second leg projecting outwardly from the other end of the first leg, away from the columnar connector. The support section and the bar section are interconnected by a pivot arrangement on both the bracket of the support section and on the free end of the second leg of the L-shaped connector to allow for relative pivotal movement of the support section and bar section about an axis which is parallel to the sidewall of the support section. The pivot arrangement can be operatively connected to toy assembly block including a hollow plastic body having an endwall, a top wall and a hollow connector plug on the top wall and opening into the hollow body. This is achieved by having the pivot arrangement properly dimensioned so that the columnar connector project from the base plate and fits snugly into the hollow connector plug of the toy assembly block.

18 Claims, 3 Drawing Sheets

PIVOT STRUCTURE AND PIVOT JOINT FOR CONSTRUCTION TOY ASSEMBLIES

BACKGROUND OF THE INVENTION

1. Field of the Invention

The present invention is concerned with construction toy assemblies and more particularly to a pivot structure as well as to a pivot joint of which the pivot structure is a component.

2. Description of the Related Art

Construction toy assemblies make use, in large part, of standard brick-like units that all have the same general features. They are hollow plastic members comprising parallelepiped rectangular bodies formed with hollow construction plugs projecting from one face only; the end of the body opposite the plug face being open to permit the insertion of like construction units. Some of these units are made for wheel mounting and others shaped to achieve angular connections or the like. Attempts are constantly made to increase the interest in these construction assemblies by diversifying the possibilities of this game, particularly by introducing new ingenious devices.

SUMMARY OF THE INVENTION

It is thus an object of the present invention to provide special units that will permit pivotally connecting together two parts of a block structure so that one may be movable relative to the other. In this manner, the invention will provide for the possibility of connecting two parts of a building or other structure at any angle with respect to one another. Another possibility is to create a draw bar pivotally connectable to a vehicle for displacing it. Other possibilities will come to mind from the disclosure given hereinbelow.

More specifically, one aspect of the invention lies in providing a pivot structure comprising: a one-piece plastic support section including: a parallelepiped rectangular body having a sidewall, and having a pivot bracket projecting from the sidewall, and a one-piece plastic bar section including: a base plate; a columnar connector, of essentially constant cross-section, projecting from one face of the base plate; an L-shaped connector having a first leg upstanding at one end from one edge of the base plate, spacedly of the columnar connector, and a second leg projecting outwardly from the other end of the first leg, away from the columnar connector, and pivot means on the bracket and on the free end of the second leg for relative pivotal movement of the support section and bar section about an axis parallel to the sidewall of the support section. The pivot bracket preferably comprises a pair of spaced cheek plates that project from the body sidewall; the pivot means then comprising pivot pins laterally projecting from the free ends of the second leg of the L-shaped connector, these pins being inserted in bearing holes through the cheeks and being preferably the ends of a round bar that is solid with the terminal edge of the connector second leg.

According to another aspect of the invention, there is provided a pivot joint which comprises a toy assembly block including a hollow parallelepiped rectangular plastic body having an end wall, a top wall and a hollow connector plug projecting perpendicularly away from the top wall, adjacent the end wall, and opening into the rectangular hollow body; the pivot joint additionally including a pivot structure of the type above described, which pivot structure is operatively connected to the toy assembly block, the latter being dimensioned so that the columnar connector of the bar section which projects from the base plate be fitted snugly into the hollow connector plug of the toy assembly block.

The above-mentioned columnar connector of the pivot structure is preferably formed of flat wings of equal length and depth radiating from the longitudinal axis, one of the wings being perpendicular to the first leg of the L-shaped connector and being formed, at its lower end, with a distancing plug having an outer edge spaced from the first leg; the end wall of the toy assembly block being fitted between this distancing lug and the first leg.

Other features and objects of the invention will become apparent from the description that follows of a preferred embodiment.

DESCRIPTION OF THE PREFERRED EMBODIMENT

Figure 1:
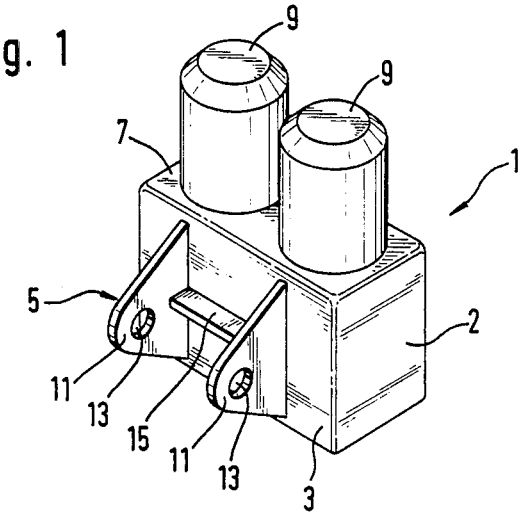
FIGS. 1 and 2 are perspective views respectively of the support section and the bar section of the pivot structure, made according to the invention.

The support section 1 of the pivot structure (FIG. 1) is a plastic one-piece member made up of a parallelepiped rectangular body 2 having a side wall 3, from which a pivot bracket 5 perpendicularly projects, and having a top wall 7 from which projects a pair of connection plugs 9, as is standard in construction toy assembly blocks. Bracket 5 consists of a pair of triangular spaced cheeks plates 11, each being formed with a pivot bearing hole 13. A strengthening strut 15 may be provided at the bottom of the cheeks 11.

Figure 3:
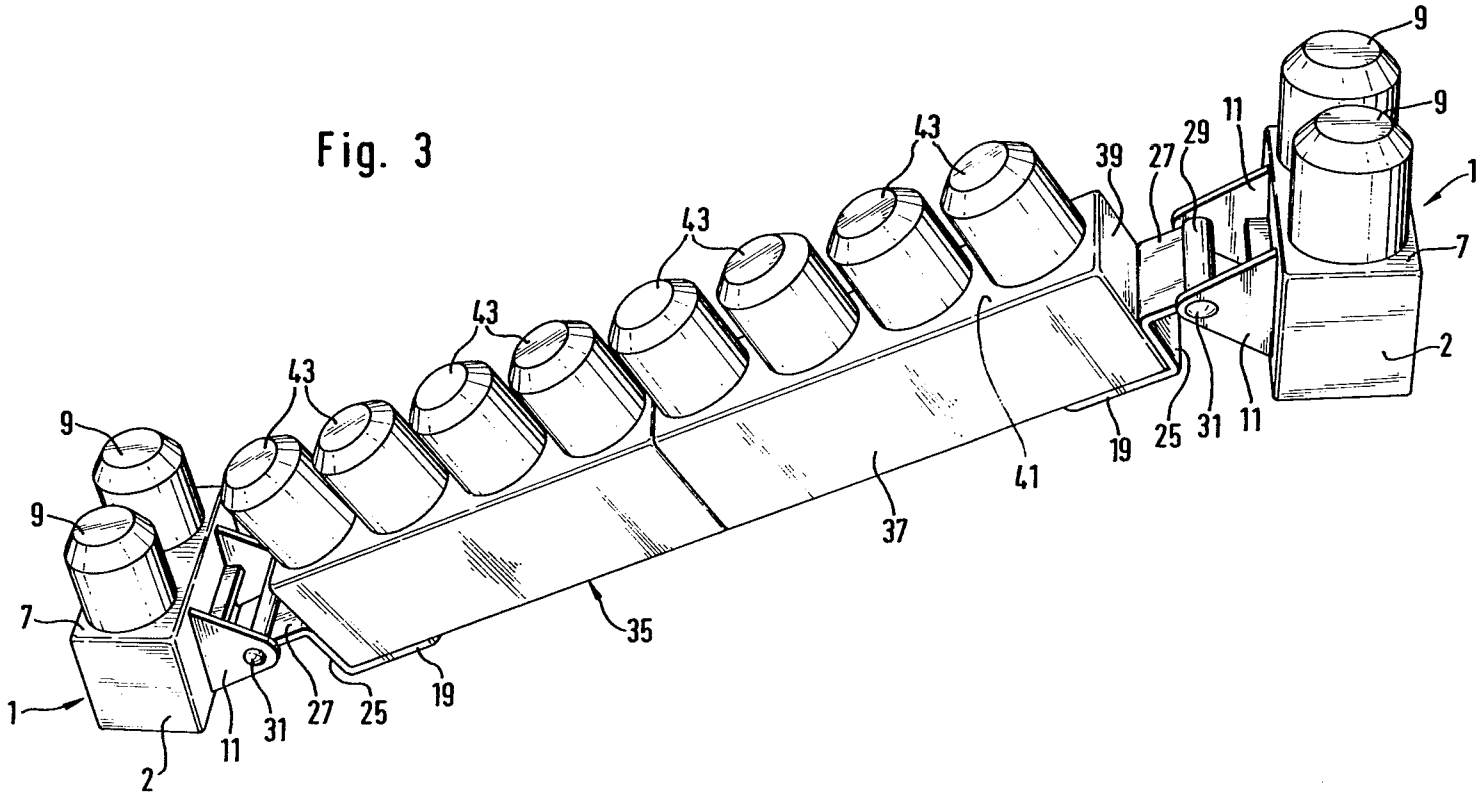
FIG. 3 is a perspective view of a bar or other structure member having pivot structures such as in FIGS. 1 and 2, thereby forming a double pivot joint, according to the invention.
Figure 5:
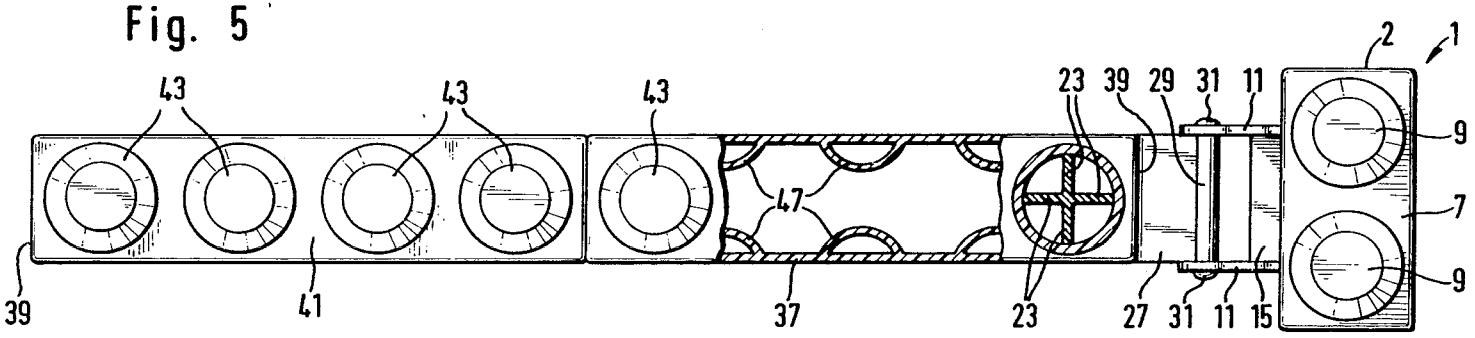
FIG. 5 is a top plan view, partly broken away, taken along line V—V of FIG. 4.
Figure 4:
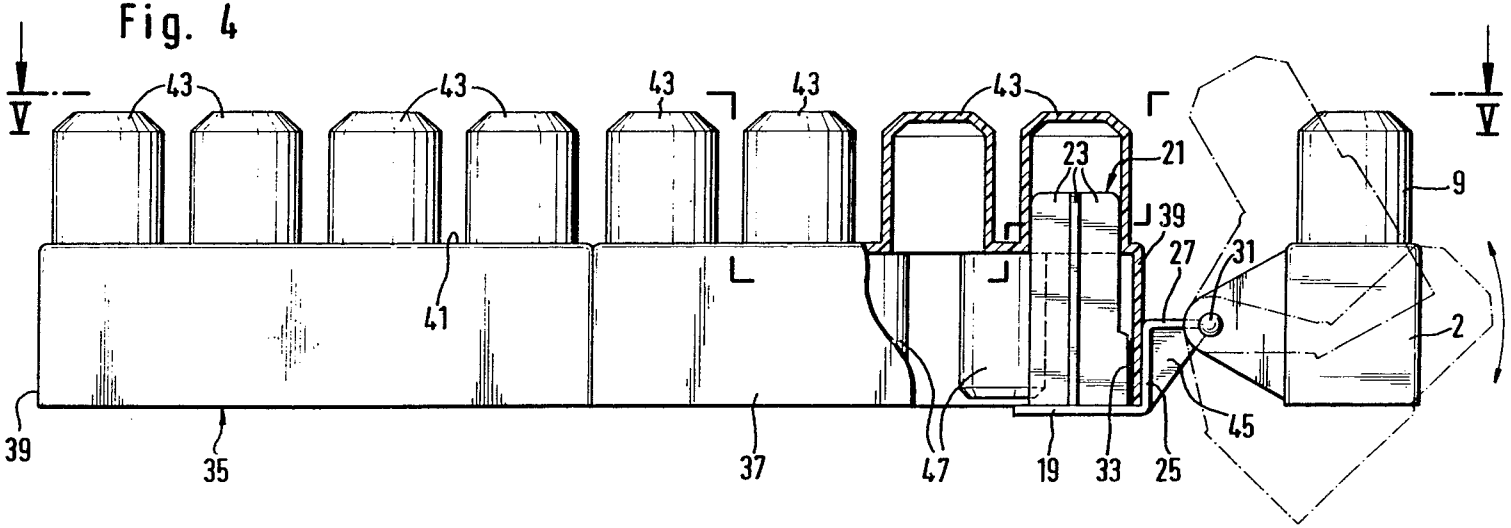
FIG. 4 is a side elevation view, partly broken away, of a bar or other structural member provided with a pivot structure at one end.

The bar section 17 (FIG. 2) of the pivot structure is, on the other hand, also a plastic one-piece member. It is made up of a flat bare plate 19 from one face of which a columnar connector 21, of constant cross-section, projects. The columnar connector 21 is preferably made up of four flat wings 23 having equal lengths and depths and radiating from the longitudinal axis of the columnar connector 21, each wing being perpendicular to the adjacent wings. As part of the bar section 17 is also an L-shaped connector having a first leg 25 upstanding at one end from one edge of the base plate 19, spacedly of the columnar connector 21, and also having a second leg 27 projecting from the leg 25 away from the columnar connector 21. A round bar 29, solid with the outer edge of the second leg 27, has terminal portions laterally projecting from the second leg 27 to form pivot pins 31 that are inserted into the pivot bearing holes 13 as shown in FIGS. 3 to 5; this being made possible by the resiliency of the plastic cheek plates 11 of the bracket 5. Thus, the pivot pins 31 and their bearing holes 13 constitute pivot means suitable to permit relative rotation of the support section 1 and the bar section 17 about an axis perpendicular to the support sidewall 3.

Figure 2:
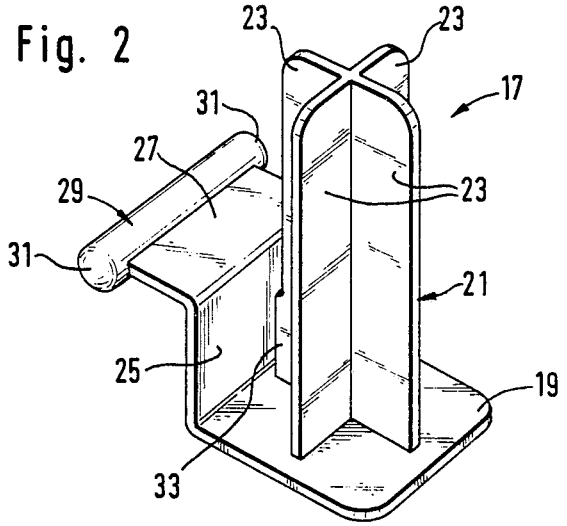

As shown in FIGS. 2 and 4, one of the two wings of the columnar connector 21 is perpendicular to the first leg 25 and is formed, at its lower end, with a distancing lug 33 having an outer edge spaced from the said first leg 25.

FIG. 3 illustrates two identical pivot structures 1, 17, mounted at the ends of a beam or drawbar or toy assembly block 35 to form two pivot joints. The toy assembly block 35 may be formed of two identical elongated units made solid with one another end-to-end. Appropriate details of one of the two identical joints are shown in FIGS. 4 and 5.

The toy assembly block 35, of standard construction, includes a hollow parallelepiped elongated rectangular plastic body 37 having end walls 39, a top wall 41 and a row of hollow connector plugs 43 between the end walls 39, the last two plugs standing short of the end walls 39 and all plugs opening into the body 37.

In the assembled condition of the pivot joint, as shown to the right of FIGS. 4 and 5, the columnar connector 21 is moved into the hollow body 37 and its upper part snugly but removably fitted into the end plug 43, both being appropriately dimensioned for that purpose. At the same time, the corresponding end wall 39 is slid between the distancing lug 33 of one of the wings 23 and the first leg 25 of the L-shaped connector 25, 27. To facilitate entry of the columnar connector 21 into the hollow end plug 43, the upper edges of the wings 23 should be rounded at their ends, as shown.

A triangular strut plate 45 may also be provided between the legs 25, 27, of the L-shaped connector, as shown in FIG. 4.

Conventional stabilizing arcuate members 47 are provided along the inner surfaces of the hollow body 37 to allow snug insertion of plugs of another toy assembly block for firmly holding two blocks together, as is known.

I claim:

1. A pivot structure comprising, in combination:

(a) a one-piece plastic support section including a parallelepiped rectangular body having a sidewall, and a pivot bracket projecting from said sidewall, and (b) a one-piece plastic bar section including: a base plate; a columnar connector of essentially constant cross-section, projecting from one face of said base plate; an L-shaped connector having a first leg upstanding at one end from one edge of said base plate, spacedly of said columnar connector, and a second leg projecting outwardly from the other end of said first leg, away from said columnar connector; and pivot means mounted on the free end of said second leg, said pivot means being structurally connected to the pivot bracket for relative pivotal movement of sid support section and bar section about an axis parallel to said sidewall of said support section.

2. A pivot structure as claimed in claim 1, wherein said pivot bracket comprises a pair of spaced cheek plates projecting from said body sidewall, and wherein said pivot means comprise pivot pins laterally projecting from the free end of said second leg of said L-shaped connector, said pins being inserted in bearing holes through said cheeks.

3. A pivot structure as claimed in claim 2, wherein said columnar connector has a longitudinal axis and is formed of flat wings of equal length and depth radiating from said longitudinal axis.

4. A pivot structure as claimed in claim 2, wherein said pivot pins are the ends of a round bar solid with the terminal edge of said connector second leg.

5. A pivot structure as claimed in claim 1, wherein said columnar connector has a longitudinal axis and is formed of flat wings of equal length and depth radiating from said longitudinal axis.

6. A pivot structure as claimed in claim 5, wherein said columnar connector has four wings distributed in the form of a cross.

7. A pivot structure as claimed in claim 5, wherein one of said wings of said columnar connector is perpendicular to said first leg of said L-shaped connector and is formed, at the lower end thereof, with a distancing lug having an outer edge spaced from said first leg.

8. A pivot joint as claimed in claim 7, wherein each columnar connector has four wings distributed in the form of a cross.

9. A pivot structure as claimed in claim 7, wherein said pivot bracket comprises a pair of spaced cheek plates projecting from sid body sidewall, and wherein said pivot means comprise pivot pins laterally projecting from the free end of said second leg of said L-shaped connector, said pins being inserted in bearing holes through said cheeks.

10. A pivot joint comprising, in combination:

a toy assembly block including a hollow parallelepiped rectangular plastic body having an end wall, a top wall and a hollow connector plug projecting perpendicularly away from said top wall adjacent said end wall and opening into said rectangular body;

an one-piece plastic bar section including: a base plate; a columnar connector of essentially constant cross-section, projecting from one face of said base plate; an L-shaped connector having a first leg upstanding at one end from one edge of said base plate, spacedly of said columnar connector, and a second leg projecting outwardly form the other end of said first leg, away from said columnar connector; and pivot means mounted on the free end of said second leg, said one-piece plastic bar being operatively connected to said toy assembly block by snugly fitting said columnar connector projecting from said base plate into said hollow connector plug of said toy assembly block; and an one-piece plastic support section including another parallelepiped rectangular body having a sidewall and a pivot bracket projecting from said sidewall, said pivot bracket being structurally connected to said pivot means of the bar section for relative pivotal movement of said support section and bar section about an axis parallel to said sidewall of said support section.

11. A pivot joint as claimed in claim 10, wherein said columnar connector has a longitudinal axis and is formed of flat wings of equal length and depth radiating from said longitudinal axis, one of sid wings being perpendicular to said first leg of said L-shaped connector and being formed, at the lower end thereof, with a distancing lug having an outer edge spaced from said first leg; and wherein said end wall of said toy assembly block is fitted between said distancing lug and said first leg.

12. A pivot joint as claimed in claim 11, wherein said pivot bracket comprises a pair of spaced cheek plates projecting from said body sidewall, and wherein said pivot means comprise pivot pins laterally projecting from the free end of said second leg of said L-shaped connector, said pins being inserted in bearing holes through said cheeks.

13. A pivot pins as claimed in claim 12, wherein said pivot pins are the ends of a round bar solid with the terminal edge of said connector second leg.

14. A pivot joint as claimed in claim 13, wherein said columnar connector has four wings distributed in the form of a cross.

15. A pivot joint comprising, in combination:

a toy assembly block including a hollow parallelepiped elongated rectangular plastic body having end walls, a top wall and a row of hollow connector plugs projecting perpendicularly away from said top wall, between said end walls; two of said plugs being respectively adjacent said end walls and opening into said hollow body;

two one-piece plastic bar sections each including: a base plate; a columnar connector of essentially constant cross-section, projecting from one face of said base plate; an L-shaped connector having a first leg upstanding at one end from one edge of said base plate, spacedly of sid columnar connector, and a second leg projecting outwardly from the other end of sid first leg, away from said columnar connector; and pivot means mounted on the free end of said second leg; each of said one-piece plastic bars being operatively connected to said toy columnar connectors into said hollow connector plugs adjacent said end walls of said toy assembly block; and two one-piece plastic support sections each including another parallelepiped rectangular body having a sidewall; and a pivot bracket projecting from said sidewall, said pivot brackets being structurally connected to said pivot means of said bar sections for relative pivotal movement of each of said support section and bar section about an axis parallel to the sidewall of said support section.

16. A pivot joint as claimed in claim 15, wherein said columnar connectors have a longitudinal axis and are formed of flat wings of equal length and depth radiating from said longitudinal axis, one of said wings of each columnar connector being perpendicular to one first leg of one of said L-shaped connectors and being formed, at the lower end thereof, with a distancing lug having an outer edge spaced from said one first leg; and wherein said end walls of said toy assembly block are fitted between said distancing lugs and said first legs, respectively.

17. A pivot joint as claimed in claim 16, wherein each pivot bracket comprises a pair of spaced cheek plates projecting from the respective body end wall, and wherein said pivot means comprise pivot pins laterally projecting from the free end of said second legs of said L-shaped connectors, said pins being inserted into bearing holes through said cheeks.

18. A pivot joint as claimed in claim 17, wherein said pivot pins are the ends of round bars solid with the terminal edges of said connector second legs.

* * * * *